US008331601B2

(12) United States Patent
Gratke et al.

(10) Patent No.: US 8,331,601 B2
(45) Date of Patent: Dec. 11, 2012

(54) ARRANGEMENT FOR MOUNTING A MICROPHONE TO AN INTERIOR SURFACE OF A VEHICLE

(75) Inventors: Jesse T. Gratke, Royal Oak, MI (US); Darryl T. Fornatoro, Warren, MI (US)

(73) Assignees: General Motors LLC, Detroit, MI (US); GM Global Technology Operations LLC, Detroit, MI (US)

( * ) Notice: Subject to any disclaimer, the term of this patent is extended or adjusted under 35 U.S.C. 154(b) by 536 days.

(21) Appl. No.: 12/548,148

(22) Filed: Aug. 26, 2009

(65) Prior Publication Data

US 2011/0051972 A1 Mar. 3, 2011

(51) Int. Cl.
*H04R 9/08* (2006.01)

(52) U.S. Cl. ..... 381/365; 381/86; 381/91; 381/355; 381/359; 381/361

(58) Field of Classification Search ..... 381/86, 381/355–356, 359, 361, 365, 375, 91
See application file for complete search history.

(56) References Cited

U.S. PATENT DOCUMENTS

| | | | | |
|---|---|---|---|---|
| 3,668,334 | A * | 6/1972 | Schwake | 455/170.1 |
| 6,243,003 | B1 * | 6/2001 | DeLine et al. | 340/425.5 |
| 6,560,344 | B1 * | 5/2003 | Julstrom et al. | 381/356 |
| 7,106,876 | B2 * | 9/2006 | Santiago | 381/369 |
| 7,171,006 | B2 * | 1/2007 | Kimura | 381/86 |
| 7,218,472 | B2 * | 5/2007 | Kaizu et al. | 360/77.02 |
| 7,218,742 | B2 * | 5/2007 | Kay et al. | 381/175 |
| 7,369,664 | B2 | 5/2008 | Kargus, IV et al. | |
| 2006/0193486 | A1 | 8/2006 | Kargus, IV et al. | |
| 2006/0204026 | A1 | 9/2006 | Kargus, IV | |
| 2007/0138825 | A1 * | 6/2007 | Linhard et al. | 296/97.8 |
| 2007/0177752 | A1 | 8/2007 | Kargus, IV | |
| 2008/0137895 | A1 * | 6/2008 | Gratke et al. | 381/359 |

* cited by examiner

*Primary Examiner* — Curtis Kuntz
*Assistant Examiner* — Ryan Robinson
(74) *Attorney, Agent, or Firm* — Ingrassia Fisher & Lorenz, P.C.

(57) ABSTRACT

A housing sub-assembly for mounting a microphone sub-assembly to a vehicle includes, but is not limited to a main body portion that is adapted to be mounted to an interior surface of the vehicle. The main body portion is configured to connect to the microphone sub-assembly and to support the microphone sub-assembly in a position such that a portion of the microphone sub-assembly protrudes beyond an end of the main body portion when the main body portion is connected to the microphone sub-assembly.

14 Claims, 4 Drawing Sheets

ARRANGEMENT FOR MOUNTING A MICROPHONE TO AN INTERIOR SURFACE OF A VEHICLE

TECHNICAL FIELD

The technical field generally relates to microphones and more particularly relates to mounting arrangements for microphones.

BACKGROUND

Many current vehicles in the marketplace are equipped with communication equipment that enables a vehicle occupant to engage in verbal communications with remotely located entities such as a call center and/or other parties. In some cases, the communication equipment uses voice recognition software to permit the vehicle occupant to give verbal commands to control the communication equipment. Accordingly, the communication equipment typically includes a microphone to facilitate the vehicle occupant's uses of the equipment.

Human voices cover a relatively wide range of frequencies. It has been observed that as the frequency of a human voice increases, the effectiveness of some microphones to receive the human voice diminishes. It has been determined that wideband microphones are more effective at receiving human voices at higher frequencies than non-wideband microphones. In some instances, it has been observed that a wideband microphone provides a 2-3% improvement over non-wideband microphones when receiving high frequency voice transmissions in conjunction with voice recognition software.

It has also been observed that some mounting arrangements used to mount microphones to an interior surface of a vehicle can adversely affect the microphone's ability to receive high frequency voice transmissions. In some instances, the apparatus used to mount a wideband microphone to an interior surface of the vehicle can completely negate the benefits derived from the use of a wideband microphone and/or can diminish the high frequency voice transmission receptivity of non-wideband microphones.

Accordingly, mounting arrangements that do not significantly diminish a microphone's ability to receive high frequency voice transmissions are desirable. Furthermore, other desirable features and characteristics will become apparent from the subsequent detailed description and the appended claims, taken in conjunction with the accompanying drawings and the foregoing technical field and background.

SUMMARY

Examples of arrangements for mounting a microphone to an interior surface of a vehicle are disclosed herein. In a first, non-limiting example, a housing sub-assembly is disclosed for mounting a microphone sub-assembly to a vehicle. The housing sub-assembly includes, but is not limited to, a main body portion that is adapted to be mounted to an interior surface of the vehicle. The main body portion is configured to connect to the microphone sub-assembly and to support the microphone sub-assembly in a position such that a portion of the microphone sub-assembly protrudes beyond an end of the main body portion when the main body portion is connected to the microphone sub-assembly.

In a second, non-limiting example, a microphone assembly that is designed to be mounted to an interior surface of a vehicle is disclosed. The microphone assembly includes, but is not limited to, a microphone sub-assembly including a microphone and a preamplifier that is electrically connected to the microphone. The microphone assembly also includes a housing sub-assembly adapted to be mounted to an interior surface of the vehicle. The housing sub-assembly includes a main body portion that is connected to the microphone sub-assembly. The main body portion is configured to support the microphone sub-assembly in a position such that a portion of the microphone sub-assembly protrudes beyond an end of the main body portion.

In a third, non-limiting example, a headliner assembly for a vehicle is disclosed. The headliner assembly includes, but is not limited to, a headliner that is configured to be attached to the vehicle. The headliner has a recess. A microphone assembly is disposed within the recess and is connected to the headliner. The microphone assembly includes, but is not limited to, a microphone sub-assembly having a microphone and a preamplifier electrically connected to the microphone. The microphone assembly also includes a housing sub-assembly that has a main body portion that is connected to the microphone sub-assembly. The main body portion is configured to support the microphone sub-assembly in a position such that a portion of the microphone sub-assembly protrudes beyond an end of the main body portion.

DESCRIPTION OF THE DRAWINGS

One or more examples will hereinafter be described in conjunction with the following drawing figures, wherein like numerals denote like elements.

DETAILED DESCRIPTION

The following detailed description is merely exemplary in nature and is not intended to limit application and uses. Furthermore, there is no intention to be bound by any expressed or implied theory presented in the preceding technical field, background, brief summary or the following detailed description.

A microphone's diminished high frequency voice transmission receptivity (hereinafter, "high frequency receptivity") can be at least partially resolved by configuring the mounting assemblies used to mount the microphones to a surface in a manner that enhances the high frequency receptivity of the microphone. For example, mounting a microphone or a microphone sub-assembly in a position such that a sound-receiving portion of the microphone protrudes from a housing that is used to mount the microphone sub-assembly to an interior surface of a vehicle will increase the microphone's high frequency receptivity. Additionally, the use of a grill that is acoustically transparent and that has no direct contact with the microphone will also enhance the microphone's high frequency receptivity. As used herein, the term "acoustically invisible" when used in conjunction with a structure shall refer to a structure having one or more openings passing through solid portions of the structure wherein the ratio of open area to solid area is sufficient to permit the transmission of audible sound energy through the structure without any diminution in audibility.

In other examples, minimizing direct contact between a microphone sub-assembly and the housing used to mount the microphone sub-assembly to a surface will also enhance a microphone's high frequency receptivity. Further, the use of wideband microphones will also enhance high frequency receptivity. Additionally, orienting the microphone or the microphone sub-assembly so that a sound receiving portion of the microphone faces the person speaking will further enhance the microphone's high frequency receptivity. Use of one or more of the techniques described above may result in the microphone producing a wideband frequency response.

A greater understanding of the examples of the apparatus disclosed herein may be obtained through a review of the illustrations accompanying this application together with a review of the detailed description that follows.

Figure 1:
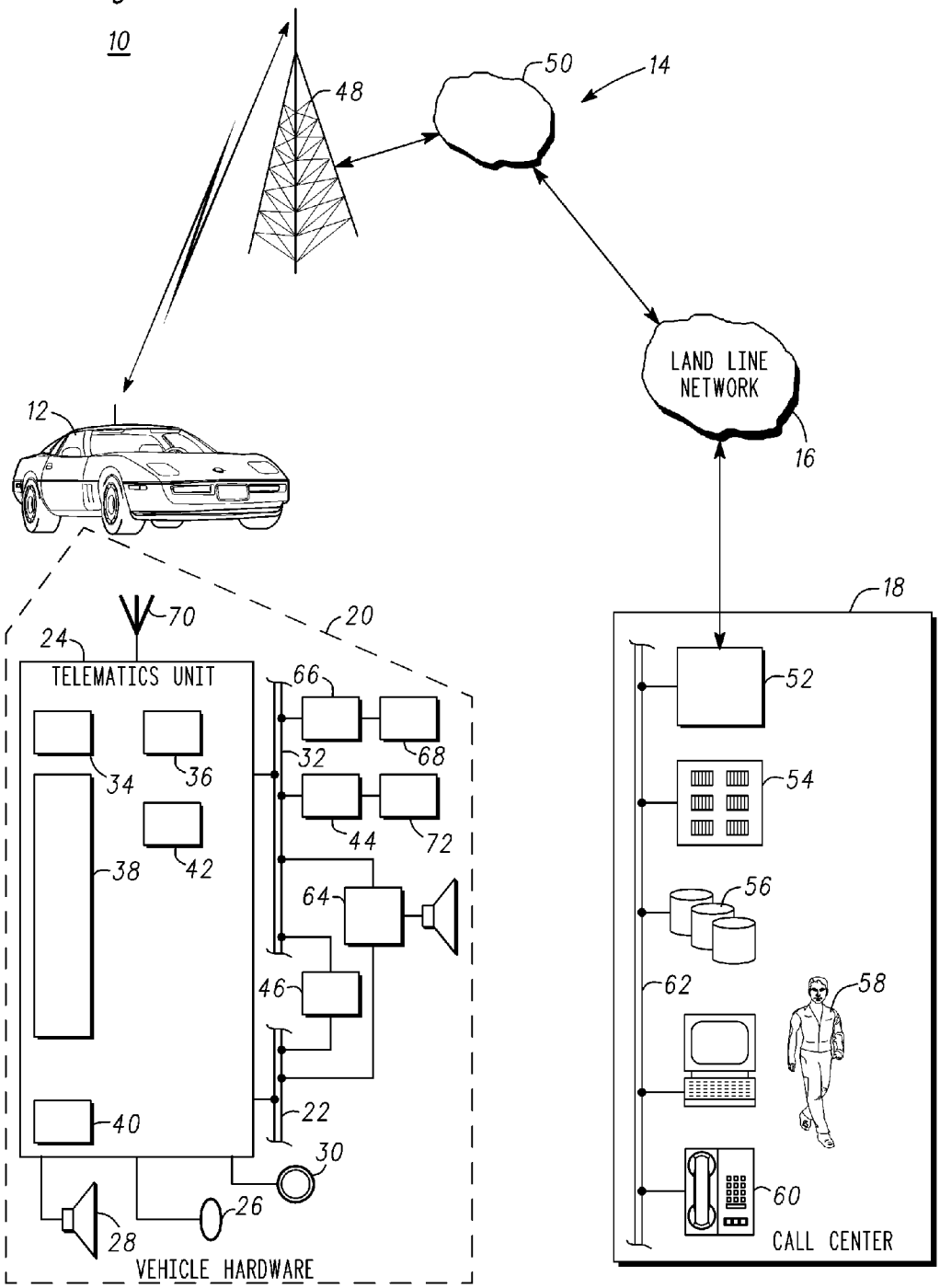
FIG. 1 is a schematic view illustrating a non-limiting example of a communication system suitable for use with communication devices that include an example of an arrangement for mounting a microphone to an interior surface of a vehicle.

With reference to FIG. 1, there is shown a non-limiting example of a communication system 10 that may be used in conjunction with examples of the apparatus disclosed herein. The communication system generally includes a vehicle 12, a wireless carrier system 14, a land network 16 and a call center 18. It should be appreciated that the overall architecture, setup and operation, as well as the individual components of the illustrated system are merely exemplary and that differently configured communication systems may also be utilized in conjunction with the examples of the apparatus disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, etc., and is equipped with suitable hardware and software that enables it to communicate over communication system 10. Some of the vehicle hardware 20 is shown generally in FIG. 1, including a telematics unit 24, a microphone 26, a speaker 28, and buttons and/or controls 30 connected to the telematics unit 24. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard device that provides a variety of services through its communication with the call center 18, and generally includes an electronic processing device 38, one or more types of electronic memory 40, a cellular chipset/component 34, a wireless modem 36, a dual mode antenna 70, and a navigation unit containing a GPS chipset/component 42. In one example, the wireless modem 36 includes a computer program and/or set of software routines adapted to be executed within electronic processing device 38.

The telematics unit 24 may provide various services including: turn-by-turn directions and other navigation-related services provided in conjunction with the GPS based chipset/component 42; airbag deployment notification and other emergency or roadside assistance-related services provided in connection with various crash and/or collision detection sensor interface modules 66 and collision sensors 68 located throughout the vehicle; and/or infotainment-related services where music, Internet web pages, movies, television programs, videogames, and/or other content are downloaded by an infotainment center 46 operatively connected to the telematics unit 24 via vehicle bus 32 and audio bus 22. In one example, downloaded content is stored for current or later playback. The above-listed services are by no means an exhaustive list of all the capabilities of telematics unit 24, but are simply an illustration of some of the services that the telematics unit may be capable of offering. It is anticipated that telematics unit 24 may include a number of additional components in addition to and/or different components from those listed above.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. In order to enable successful data transmission over the voice channel, wireless modem 36 applies some type of encoding or modulation to convert the digital data so that it can be communicated through a vocoder or speech codec incorporated in the cellular chipset/component 34. Any suitable encoding or modulation technique that provides an acceptable data rate and bit error can be used with the present examples. Dual mode antenna 70 services the GPS chipset/component 42 and the cellular chipset/component 34.

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with the telematics unit 24 or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more of the vehicle hardware components 20. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The vehicle audio component 64 is operatively connected to the vehicle bus 32 and the audio bus 22. The vehicle audio component 64 receives analog information, rendering it as sound, via the audio bus 22. Digital information is received via the vehicle bus 32. The vehicle audio component 64 provides amplitude modulated (AM) and frequency modulated (FM) radio, compact disc (CD), digital video disc (DVD), and multimedia functionality independent of the infotainment center 46. Vehicle audio component 64 may contain a speaker system, or may utilize speaker 28 via arbitration on vehicle bus 32 and/or audio bus 22.

The vehicle crash and/or collision detection sensor interface modules 66 is operatively connected to the vehicle bus 32. The collision sensors 68 provide information to the telematics unit via the crash and/or collision detection sensor interface modules 66 regarding the severity of a vehicle collision, such as the angle of impact and the amount of force sustained.

Vehicle sensors 72, connected to various sensor interface modules 44 are operatively connected to the vehicle bus 32. Example vehicle sensors include but are not limited to gyroscopes, accelerometers, magnetometers, emission detection, and/or control sensors, and the like. Example sensor interface modules 44 include powertrain control, climate control, and body control, to name but a few.

Wireless carrier system 14 may be a cellular telephone system or any other suitable wireless system that transmits signals between the vehicle hardware 20 and land network 16. According to an example, wireless carrier system 14 includes one or more cell towers 48, base stations and/or mobile switching centers (MSCs) 50, as well as any other networking components required to connect the wireless carrier system 14 with land network 16. As appreciated by those skilled in the art, various cell tower/base station/MSC arrangements are possible and could be used with wireless carrier system 14. For example, a base station and a cell tower could be co-located at the same site or they could be remotely located, and a single base station could be coupled to various cell towers or various base stations could be coupled with a single MSC, to list but a few of the possible arrangements. A speech codec or vocoder may be incorporated in one or more of the base stations, but depending on the particular architecture of the wireless network, it could be incorporated within a Mobile Switching Center or some other network components as well.

Land network 16 can be a conventional land-based telecommunications network that is connected to one or more landline telephones, and that connects wireless carrier system 14 to call center 18. For example, land network 16 can include a public switched telephone network (PSTN) and/or an Internet protocol (IP) network, as is appreciated by those skilled in the art. Of course, one or more segments of the land network 16 can be implemented in the form of a standard wired network, a fiber or other optical network, a cable network, other wireless networks such as wireless local networks (WLANs) or networks providing broadband wireless access (BWA), or any combination thereof.

Call center 18 is designed to provide the vehicle hardware 20 with a number of different system back-end functions and, according to the example shown here, generally includes one or more switches 52, servers 54, databases 56, advisors 58, as well as a variety of other telecommunication/computer equipment 60. These various call center components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either the live advisor 58 or an automated response system, and data transmissions are passed on to a modem or other piece of equipment 60 for demodulation and further signal processing. The modem 60 may include an encoder, as previously explained, and can be connected to various devices such as a server 54 and database 56. For example, database 56 could be designed to store subscriber profile records, subscriber behavioral patterns, or any other pertinent subscriber information. Although the illustrated example has been described as it would be used in conjunction with a manned call center 18, it will be appreciated that the call center 18 can be any central or remote facility, manned or unmanned, mobile or fixed, to or from which it is desirable to exchange voice and data.

Figure 2:
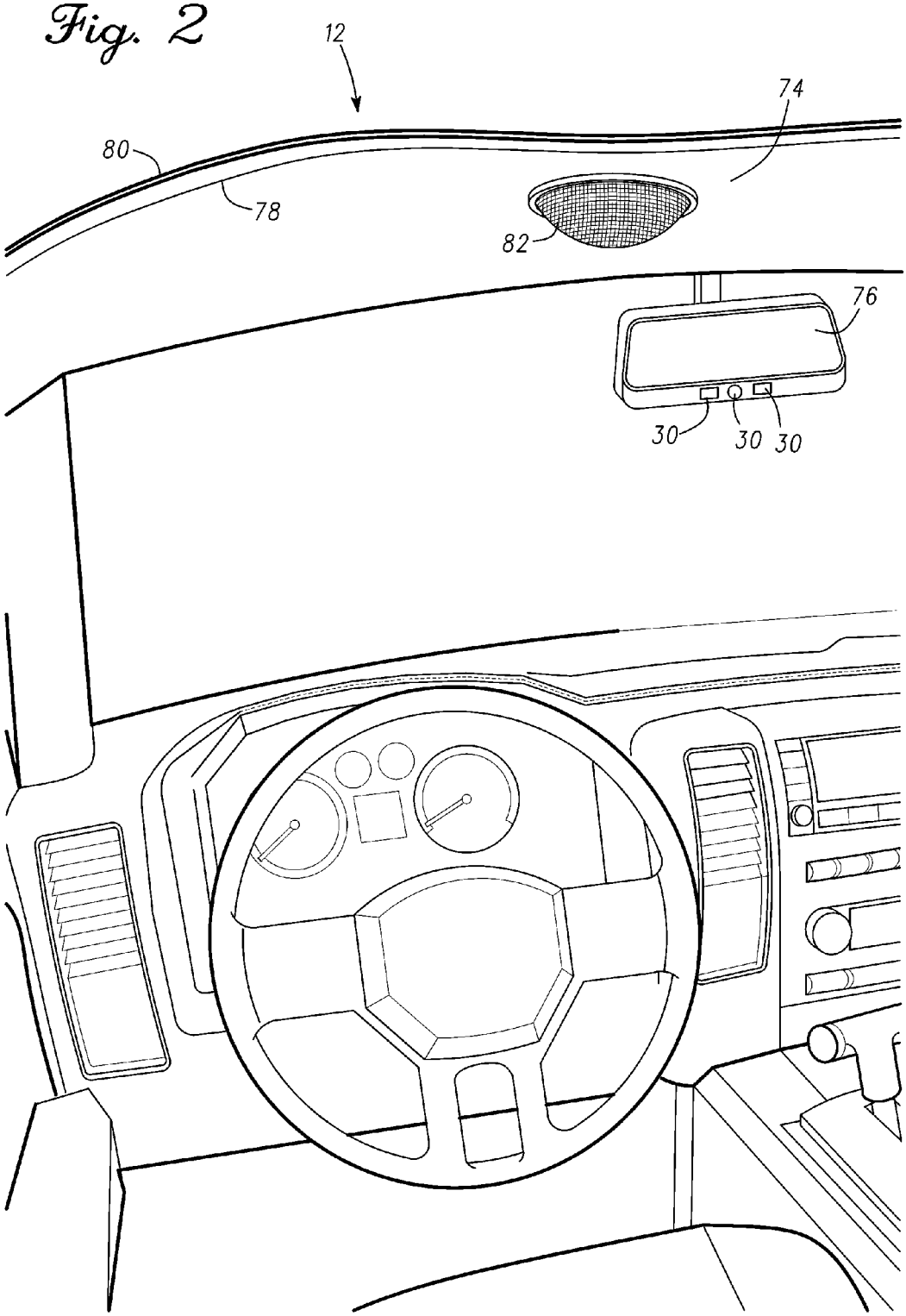
FIG. 2 is a cut-away, perspective view illustrating the interior of a vehicle equipped with a non-limiting example of an arrangement for mounting a microphone to an interior surface of a vehicle.

FIG. 2 is a cut-away, perspective view illustrating an interior 74 of vehicle 12. Vehicle 12 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD), or all-wheel drive (AWD). Although an automobile is depicted in FIG. 2, it should be understood that the teachings of the present disclosure are equally compatible with other sorts of vehicles including air craft, water craft and space craft.

Interior 74 includes a rear view mirror 76 that permits a driver of vehicle 12 to observe traffic and other conditions located to the rear of vehicle 12. In the illustrated example, buttons and/or controls 30 are mounted on a lower portion of rear view mirror 76 and are configured to send a signal to telematics unit 24 requesting an action. For example, when depressed, buttons and/or controls 30 may transmit a signal to telematics unit 24 to initiate contact with call center 18. Although buttons and/or controls 30 are illustrated as being mounted to rear view mirror 76, in other examples, buttons and/or controls 30 may be mounted to any suitable surface within interior 74.

Interior 74 includes a headliner assembly 78 mounted to an interior surface of vehicle roof 80. In an example, headliner assembly 78 provides an aesthetically pleasing appearance and may also serve to provide sound deadening, cushioning, and concealment of various different types of vehicle components. In some examples, headliner assembly 78 may comprise a single layer of material. In other examples, headliner assembly 78 may comprise multiple layers of material(s). Some materials used in the construction of headliner assembly 78 may include, but are not limited to, various different types of fabric, plastic materials and/or foam materials.

In the illustrated example, a microphone assembly 82 is mounted to headliner assembly 78. Microphone assembly 82 houses microphone 104 (see FIGS. 3-7) and may be used by a driver or other occupant of vehicle 12 to verbally communicate with an advisor 58 at call center 18 and/or to interact with telematics unit 24, or with other portions of the vehicle hardware 20. In the illustrated example, microphone assembly 82 is mounted to headliner assembly 78 and is positioned generally in an area above, and forward of, a location where the driver of vehicle 12 is expected to sit. It should be understood that although microphone assembly 82 is depicted as being mounted to headliner assembly 78, in other examples, microphone assembly 82 may be mounted to any suitable surface within interior 74 including, but not limited to, a trim component, A pillars, B pillars, C pillars, dash boards, consoles, steering wheels, seat assemblies, visors, and mirrors.

Figure 3:
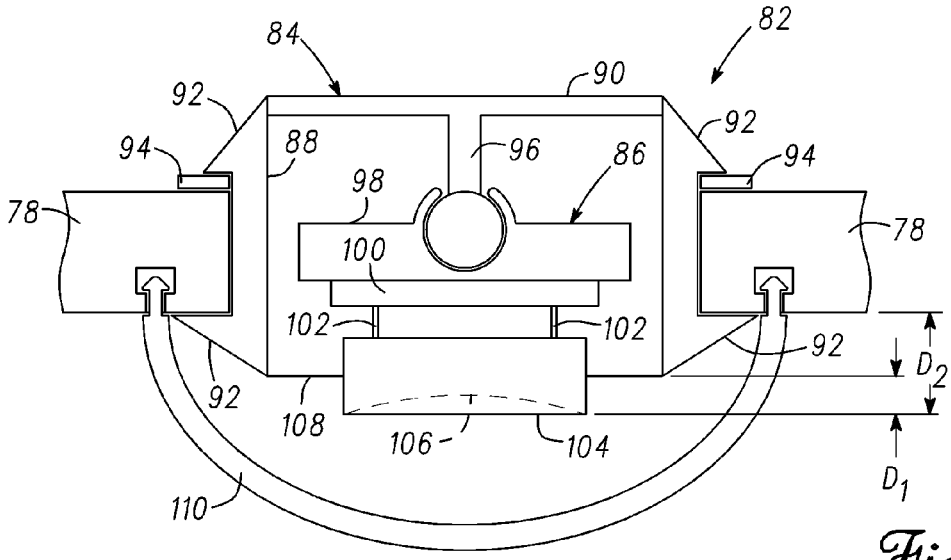
FIG. 3 is a schematic, cross-sectional view illustrating a non-limiting example of the arrangement of FIG. 2.

With respect to FIG. 3. a schematic side view is presented of an example of a microphone assembly 82 made in accordance with the teachings of the present disclosure. The illustrated example depicts microphone assembly 82 mounted to headliner assembly 78 and illustrates several of the features discussed above for enhancing the high frequency receptivity of microphone 104.

As illustrated, microphone assembly 82 includes a housing sub-assembly 84 and a microphone sub-assembly 86. Housing sub-assembly 84 comprises any suitable material including, but not limited to, plastic, metal, and ceramic materials. Housing sub-assembly 84 includes a main body portion 88 having a generally tubular or cylindrical configuration defining a generally open interior pocket. In other examples, main body portion 88 may have any suitable configuration effective to receive and support microphone sub-assembly 86 in a generally isolated manner or in any other manner such that microphone sub-assembly 86 has minimal direct contact with housing sub-assembly 84 or other any other component.

In the example illustrated in FIG. 3, housing sub-assembly 84 includes a housing cover 90 covering an upper end of main body portion 88. In some examples, housing cover 90 may be a separate component that is joined to main body portion 88 by any means including, but not limited to, a hinge, a mechanical fastener, a weld or an adhesive. In other examples, housing cover 90 may be formed integrally with main body portion 88. In still other examples, such as those illustrated below in FIGS. 4 and 5, housing sub-assembly 84 may not include housing cover 90.

Housing sub-assembly 84 further includes a pair of snap-fit fasteners 92 connected to an outer portion of main body portion 88. Snap-fit fasteners 92 may be integrally formed with main body portion 88 or they may be separately fabricated and then attached to main body portion 88. The snap-fit fasteners 92 are configured to connect housing sub-assembly 84 to headliner assembly 78. In the illustrated example, headliner assembly 78 includes a headliner back plate 94 to provide added structural support to headliner assembly 78 which may comprise fabric or foam or other relatively weak material. In other examples, a greater or lesser number of snap fit fasteners 92 may be employed to secure housing sub-assembly 84 to headliner assembly 78. In still other examples, other types of fasteners including, but not limited to, mechanical fasteners, adhesives, and welds, may be employed to secure housing sub-assembly 84 to headliner assembly 78.

Housing sub-assembly 84 further includes a single structure, prong 96, extending in a generally downward direction from housing cover 90. Prong 96 unilaterally connects housing sub-assembly 84 to microphone sub-assembly 86. In the illustrated example, no other part of housing sub-assembly 84 is in direct contact with microphone sub-assembly 86. While the illustrated example depicts prong 96 extending downwardly from housing cover 90, it should be understood that in other examples, prong 96 may extend from any portion or surface of main body portion 88.

In the example illustrated in FIG. 3, microphone sub-assembly 86 includes a back plate 98, a preamplifier 100, a pair of conductors 102 and a microphone 104. Back plate 98 is a platform comprising any suitable material including, but not limited to plastic, metal, rubber, metal, and ceramic. Back plate 98 is configured to connect to prong 96. In the example illustrated in FIG. 3, prong 96 is configured to include a ball joint and back plate 98 includes a socket that is configured to engage the ball joint of prong 96. In other examples, any suitable configuration that permits prong 96 to engage back plate 98 may be implemented, including, but not limited to, snap fit configurations, tab and slot configurations, hook and loop configurations, adhesives and welds.

Preamplifier 100 is connected to back plate 98. In the illustrated example, back plate 98 is connected to preamplifier 100 by an adhesive. In other examples, any suitable fastener including, but not limited to, a snap-fit arrangement, a tab in slot arrangement, a hook and loop arrangement, and/or a threaded fastener may be employed, without limitation. Preamplifier 100 is connected to microphone 104 by the pair of conductors 102. Conductors 102 may comprise copper wire or other conducting metal wire and may or may not be insulated. Conductors 102 serve the dual purpose of electrically connecting microphone 104 to preamplifier 100 and also physically supporting microphone 104 in a substantially fixed position with respect to preamplifier 100. In other examples, separate mechanical means may be implemented to mechanically connect microphone 104 to preamplifier 100. In still other examples, preamplifier 100 may be mounted inside of microphone 104. In such examples, microphone 104 may be mounted directly to back plate 98 or directly to housing sub-assembly 84.

In some examples, microphone 104 may comprise a wide-band electrets condenser microphone. In other examples, any suitable type of microphone may be employed.

In the illustrated example, microphone 104 includes a sound receiving portion 106 configured to receive audible sound energy. As illustrated, prong 96 supports microphone sub-assembly 86 in a position such that sound receiving portion 106 of microphone 104 protrudes beyond an end 108 of main body portion 88 by a distance D1. The sound receiving portion 106 of microphone 104 also extends beyond a lower portion of headliner assembly 78 by a distance D2. In this manner, the sound receiving portion 106 of microphone 104 extends into interior 74 of vehicle 12.

An acoustically invisible grill 110 is attached to headliner assembly 78 via a snap fit arrangement and is positioned to cover microphone sub-assembly 86 and housing sub-assembly 84, concealing these components from view from within the interior 74 of vehicle 12. In other examples, such as those illustrated in FIGS. 4 and 5, acoustically invisible grill 110 may be attached to housing sub-assembly 84. In the illustrated example, acoustically invisible grill 110 is configured as a dome having an inner surface that is spaced apart from, and out of direct contact with, microphone 104. In other examples acoustically invisible grill 110 may have any other suitable configuration effective to cover microphone sub-assembly 86 and housing sub-assembly 84 while remaining spaced apart from microphone 104.

As depicted in FIG. 3, microphone 104 is disposed within a generally hollow pocket comprising an interior portion of main body portion 88 and an interior portion of acoustically invisible grill 110. Further, microphone sub-assembly 86 has only minimal direct contact with housing sub-assembly 84, or with any other component. In the illustrated example, this is accomplished through the use of a single prong 96 which unilaterally connects microphone sub-assembly 86 to housing sub-assembly 84 and is the only structure of housing sub-assembly 84 to have any direct contact with microphone sub-assembly 86. By minimizing direct contact between housing sub-assembly 84 and microphone sub-assembly 86, the high frequency receptivity of microphone 104 is enhanced.

Figure 4:
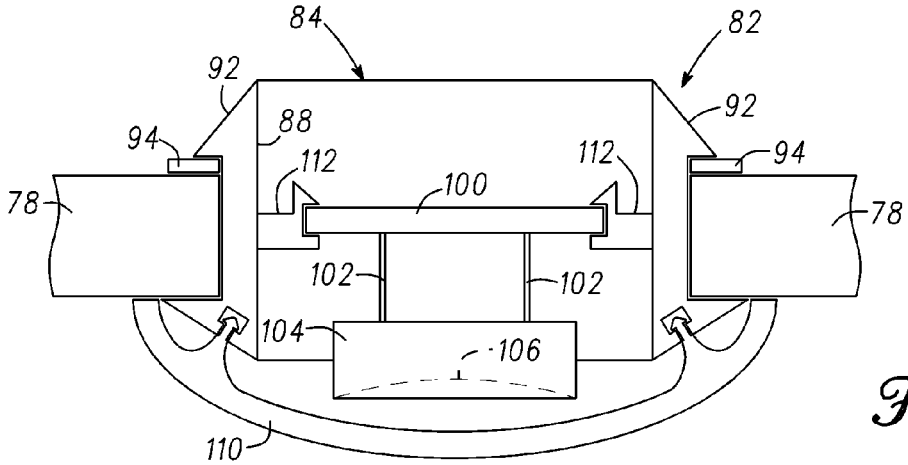
FIG. 4 is a schematic, cross-sectional view illustrating another non-limiting example of the arrangement of FIG. 2.

With respect to FIG. 4, a schematic side view is presented of another example of a microphone assembly 82 made in accordance with the teachings of the present disclosure. In the example illustrated in FIG. 4, housing sub-assembly 84 does not include a housing cover, but instead, has an uncovered upper end.

The housing sub-assembly 84 illustrated in FIG. 4 includes a pair of structures, prongs 112, which protrude inwardly from generally opposite ends of an internal surface of main body portion 88. Each one of the prongs 112 is configured to have a snap fit engagement with microphone sub-assembly 86. The pair of prongs 112 cooperate to unilaterally connect housing sub-assembly 84 to microphone sub-assembly 86 and to support microphone sub-assembly 86 in a position such that the sound receiving portion 106 of microphone 104 protrudes beyond a lower end of main body portion 88.

The microphone sub-assembly 86 of FIG. 4 does not include a back plate. Rather, in the illustrated example, the preamplifier 100 is mounted directly to housing sub-assembly 84 via snap fit engagement with prongs 112.

Figure 5:
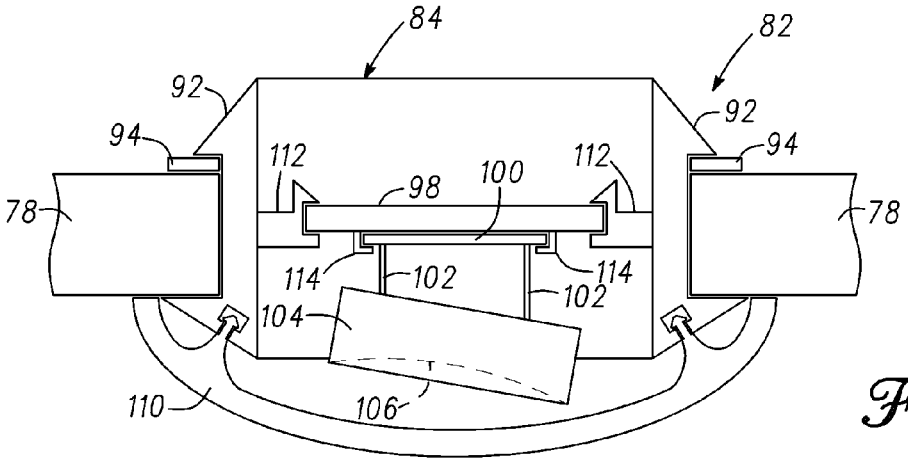
FIG. 5 is a schematic, cross-sectional view illustrating yet another non-limiting example of the arrangement of FIG. 2.

In FIG. 3, a ball joint and socket arrangement was employed to connect microphone sub-assembly 86 to housing sub-assembly 84. In FIGS. 4 and 5, the two prongs 112 cooperate to connect housing sub-assembly 84 to microphone sub-assembly 86 in a snap fit arrangement. It should be understood that these are merely exemplary arrangements for effecting the connection between housing sub-assembly 84 and microphone sub-assembly 86. A wide variety of other means for effecting the connection may also be employed. For example, in addition to the snap fit and ball joint/socket arrangements, the connection may be effected using adhesives, welds, tabs and slots, hooks and loops, retracting tabs, an interference fit, and posts and recesses.

With respect to FIG. 5. a schematic side view is presented of yet another example of a microphone assembly 82 made in accordance with the teachings of the present disclosure. In the example illustrated in FIG. 5, preamplifier 100 is connected to back plate 98 through engagement with back plate prongs 114 that form slots which are configured to receive opposite ends of preamplifier 100.

Microphone 104 in FIG. 5 is canted at an angle with respect to a plane containing back plate 98 such that microphone 104 and back plate 98 are oriented in a non-parallel arrangement. The sound receiving portion 106 of microphone 104 is also canted in a non-parallel orientation with respect to a plane containing housing sub-assembly 84. This non-parallel orientation permits the sound receiving portion 106 of microphone 104 to be pointed in a desired direction. For example, the arrangement illustrated in FIG. 5 permits the sound receiving portion 106 of microphone 104 to face a driver of vehicle 12. In other examples, the sound receiving portion 106 may face in any other desired direction.

In FIG. 5, the angled orientation of microphone 104 is achieved through the use of unequal length conductors 102. In other examples, microphone 104 may be canted at a desired angle using any other suitable mechanism or mechanical means. In still other examples, microphone 104 may be shaped to position the sound receiving portion in a canted orientation. In examples where preamplifier 100 is mounted inside of microphone 104, may be canted by the mechanism or mechanical means used to attach microphone 104 to housing sub-assembly 84.

Figure 6:
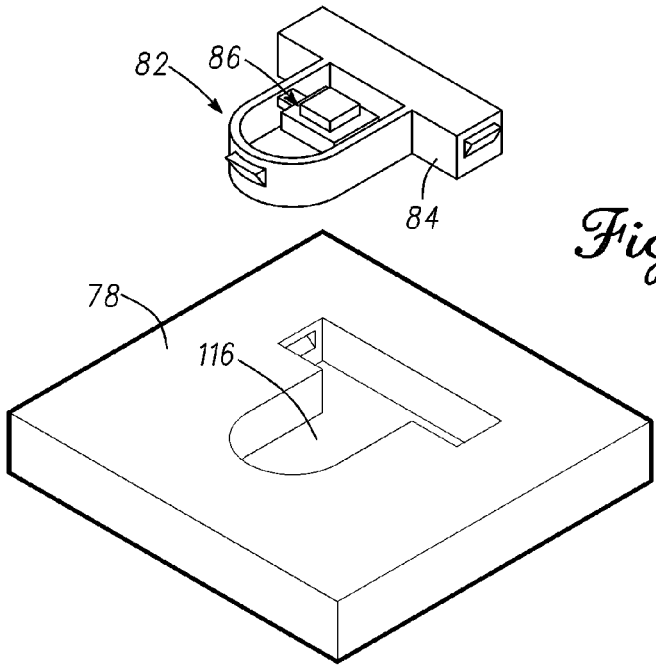
FIGS. 6 and 7 illustrate the features and assembly of another non-limiting example of an arrangement for mounting a microphone to an interior surface of a vehicle.
Figure 7:
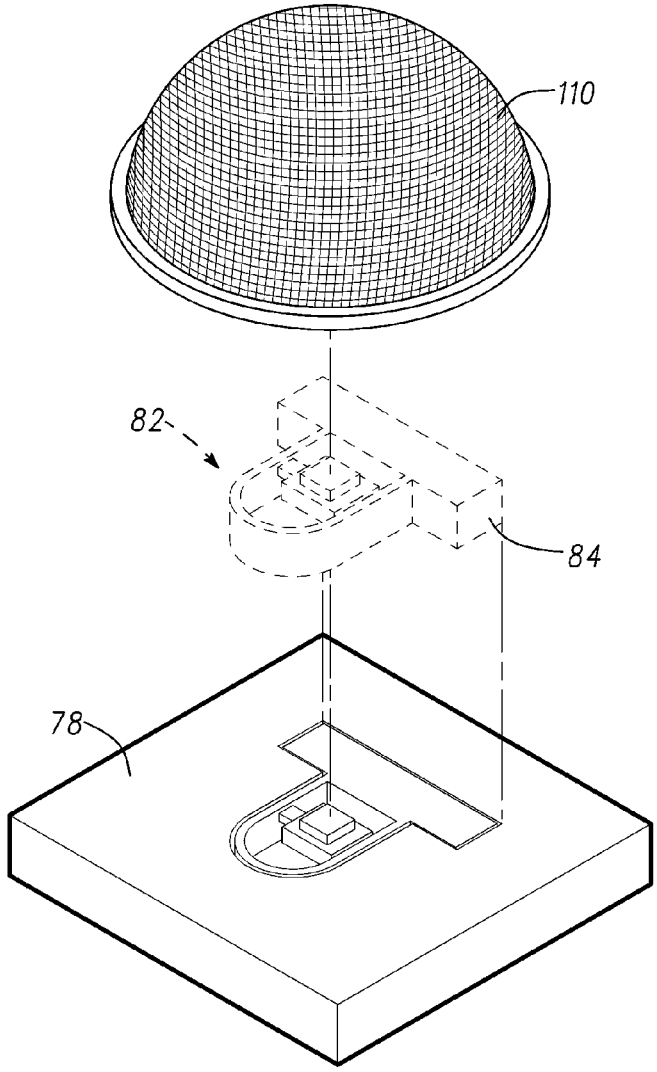

FIGS. 6-7 illustrate an arrangement for attaching microphone assembly 82 to headliner assembly 78. Headliner assembly 78 defines a recess 116 for receiving microphone assembly 82. As illustrated, microphone assembly 82 is generally aligned with recess 116 and then pushed or otherwise positioned within recess 116.

In examples where the material comprising headliner assembly 78 is soft or weak, headliner back plate 94 (see FIGS. 3-5) may be positioned behind recess 116 and the attachment features on microphone assembly 82 engage with headliner back plate 94 when microphone assembly 82 is fully seated within recess 116.

Once microphone assembly 82 is attached to headliner assembly 78, acoustically invisible grill 110 is connected to main body portion 88. In some examples, acoustically invisible grill 110 may connect directly to headliner assembly 78 using snap fit connectors or other mechanical means effective to support acoustically invisible grill 110. In still other examples, acoustically invisible grill 110 may be integral with main body portion 88 and would, therefore, not require attachment to main body portion 88.

In examples of microphone assembly 82 wherein the sound receiving portion 106 of microphone 104 is canted at a transverse angle with respect to housing sub-assembly 84, it may be desirable to install microphone assembly 82 in a specific or predetermined orientation within headliner assembly 78 as this will ensure that the sound receiving portion 106 of microphone 104 faces in a desired direction.

One way to ensure that housing sub-assembly 84 has the desired orientation with respect to headliner assembly 78 is to configure recess 116 as a keyway. In this manner, recess 116 will permit the insertion of a correspondingly configured housing sub-assembly 84 only when the housing sub-assembly 84 is properly aligned with recess 116, i.e., when corresponding contours of recess 116 and housing sub-assembly 84 are in alignment. An exemplary recess 116 configured as a keyway is illustrated in FIG. 6. As illustrated, housing sub-assembly 84 will only fit within recess 116 when their corresponding features are in alignment.

While at least one example has been presented in the foregoing detailed description, it should be appreciated that a vast number of variations exist. It should also be appreciated that the example or examples are not intended to limit the scope, applicability, or configuration in any way. Rather, the foregoing detailed description will provide those skilled in the art with a convenient road map for implementing the example or exemplary examples. It should be understood that various changes can be made in the function and arrangement of elements without departing from the scope as set forth in the appended claims and the legal equivalents thereof.

What is claimed is:

1. A housing sub-assembly for mounting a microphone sub-assembly to a vehicle, the housing sub-assembly comprising:

a main body portion adapted to be mounted to an interior surface of the vehicle, the main body portion being configured to connect to the microphone sub-assembly and to support the microphone sub-assembly in a position such that a portion of the microphone sub-assembly protrudes beyond an end of the main body portion when the main body portion is connected to the microphone sub-assembly; and an acoustically transparent grill disposed adjacent the main body portion and positioned to cover the microphone sub-assembly when the main body portion is connected to the microphone sub-assembly, wherein the housing sub-assembly is substantially free of any structure positioned between the portion of the microphone sub-assembly and the acoustically transparent grill when the main body portion is connected to the microphone sub-assembly, and wherein the main body portion includes a pair of structures, each structure being configured to connect to the microphone sub-assembly and to support the microphone sub-assembly, the pair of structures unilaterally connecting the main body portion to the microphone sub-assembly and unilaterally supporting the microphone sub-assembly in the position.

2. The housing sub-assembly of claim 1 wherein the main body portion includes a means for connecting to the microphone sub-assembly and for supporting the microphone sub-assembly in the position.

3. The housing sub-assembly of claim 1 wherein the acoustically transparent grill is configured to be spaced apart from the microphone sub-assembly when the main body portion is connected to the microphone sub-assembly.

4. The housing sub-assembly of claim 1 wherein the acoustically transparent grill is configured as a dome.

5. A microphone assembly for use with a vehicle, the microphone assembly comprising:

a microphone sub-assembly including a microphone and a preamplifier electrically connected to the microphone; and a housing sub-assembly adapted to be mounted to an interior surface of the vehicle, the housing sub-assembly including a main body portion connected to the microphone sub-assembly, the main body portion being configured to support the microphone sub-assembly in a position such that a portion of the microphone sub-assembly protrudes beyond an end of the main body portion and an acoustically transparent grill disposed adjacent the main body portion and positioned to cover the microphone sub-assembly, wherein the housing sub-assembly is substantially free of any structure positioned between the portion of the microphone sub-assembly and the acoustically transparent grill and wherein the main body portion includes a pair of structures unilaterally connecting the main body portion to the microphone sub-assembly and unilaterally supporting the microphone sub-assembly in the position.

6. The microphone assembly of claim 5 wherein the microphone is a wideband microphone.

7. The microphone assembly of claim 5 wherein the main body portion is connected to the preamplifier.

8. The microphone assembly of claim 5 wherein the microphone sub-assembly further includes a back plate connected to the preamplifier and wherein the main body portion is connected to the back plate.

9. The microphone assembly of claim 5 wherein the microphone includes a sound receiving portion and wherein the main body portion is configured to support the microphone sub-assembly in a position such that the sound receiving portion protrudes beyond an end of the main body portion.

10. The microphone assembly of claim 5 wherein the microphone includes a sound receiving portion and wherein the sound receiving portion faces a driver of the vehicle when the housing sub-assembly is mounted to the interior surface of the vehicle.

11. The microphone assembly of claim 5 wherein the acoustically transparent grill is configured to be spaced apart from the microphone sub-assembly to avoid direct contact with the microphone.

12. A headliner assembly for a vehicle, the headliner assembly comprising:

a headliner configured for attachment to the vehicle, the headliner having a recess; and a microphone assembly disposed within the recess and connected to the headliner, the microphone assembly including:

a microphone sub-assembly including a microphone and a preamplifier electrically connected to the microphone; and a housing sub-assembly including a main body portion connected to the microphone sub-assembly, the main body portion being configured to support the microphone sub-assembly in a position such that a portion of the microphone sub-assembly protrudes beyond an end of the main body portion and an acoustically transparent grill disposed adjacent the main body portion and positioned to cover the microphone sub-assembly, wherein the housing sub-assembly is substantially free of any structure positioned between the portion of the microphone sub-assembly and the acoustically transparent grill and wherein the recess is configured as a keyway and wherein the main body portion is configured to conform to the keyway such that the recess obstructs insertion of the housing sub-assembly when the main body portion and the recess are out of alignment and wherein the recess permits insertion of the housing sub-assembly when the main body portion and the recess are aligned.

13. The headliner assembly of claim 12 wherein the microphone comprises a wideband microphone including a sound receiving portion and wherein the main body portion is configured to support the microphone sub-assembly in a position such that the sound receiving portion protrudes out of the recess.

14. The headliner assembly of claim 12 wherein the acoustically transparent grill is configured to be spaced apart from the microphone sub-assembly to avoid direct contact with the microphone.

* * * * *